United States Patent [19]

Kratz et al.

[11] Patent Number: 4,778,277

[45] Date of Patent: Oct. 18, 1988

[54] MIXING DEVICE

[75] Inventors: Gerhard Kratz, Rodgau; Helmut Walter, Offenbach; Eckhard Fischer, Ranstadt, all of Fed. Rep. of Germany

[73] Assignee: Kraftwerk Union Aktiengesellschaft, Mülheim an der Ruhr, Fed. Rep. of Germany

[21] Appl. No.: 763,828

[22] Filed: Aug. 8, 1985

[30] Foreign Application Priority Data

Aug. 9, 1984 [DE] Fed. Rep. of Germany ..... 3429412

[51] Int. Cl.[4] ..... B28C 5/16; B28C 7/16; B01F 7/08

[52] U.S. Cl. ..... 366/51; 366/52; 366/67; 366/319; 366/320

[58] Field of Search ..... 366/38, 52, 64, 67, 366/65, 320, 27, 30, 40, 79, 318, 321, 322, 309, 310, 319, 51, 28, 35, 34, 33, 37, 19, 157, 66, 42, 133, 343; 198/657, 676, 659, 660, 671, 677; 222/413, 412, 227, 240, 342

[56] References Cited

U.S. PATENT DOCUMENTS

| | | | |
|---|---|---|---|
| 896,551 | 8/1908 | Jurgens | 366/319 X |
| 1,506,142 | 8/1924 | Stubbs | 366/64 |
| 3,186,602 | 6/1965 | Ricciardi | 366/320 X |
| 3,380,716 | 4/1968 | Arter | 366/320 X |
| 3,417,968 | 12/1968 | Schlecht | 366/320 X |
| 3,967,815 | 7/1976 | Backus et al. | 366/64 |
| 4,201,484 | 5/1980 | Sasiela et al. | 366/320 X |

FOREIGN PATENT DOCUMENTS

| | | | |
|---|---|---|---|
| 3202518 | 8/1982 | Fed. Rep. of Germany . | |
| 3241193 | 5/1984 | Fed. Rep. of Germany | 366/52 |

*Primary Examiner*—Harvey C. Hornsby
*Assistant Examiner*—Scott J. Haugland
*Attorney, Agent, or Firm*—Herbert L. Lerner; Laurence A. Greenberg

[57] ABSTRACT

Mixing device for embedding biologically harmful wastes in a solidifying binder, includes a tubular housing, an assembly of a pre-mixer, a pass-through mixer and a discharge pump having rotatingly movable parts disposed along a common rotational axis and in substantially vertical direction within the tubular housing, and a drive motor mounted at the upper end of the assembly for rotating the movable parts in common, the movable part of the pre-mixer being centrically disposed in the housing, and the movable part of the discharge pump being eccentrically disposed with play in the housing.

6 Claims, 3 Drawing Sheets

MIXING DEVICE

The invention relates to a mixing device for embedding biologically harmful and, in particular, radioactive wastes in a solidifying binder, which includes a pre-mixer, a continuous-operation or pass-through mixer and a discharge pump.

A device of the aforementioned general type heretofore known from German published Non-Prosecuted Application (DE-OS) No. 32 02 518 has three spindles which are arranged perpendicularly to one another, encompass in part several movable members each of which is actuated by a drive motor of its own. The so-called continuous-run or pass-through mixer shaft serves, in this regard, simultaneously as a discharge pump because it extends up to a discharge opening from a transport screw or worm conveyor with which dry cement is brought up. Nevertheless, the heretofore known device is costly not only from the standpoint of manufacture but also from the standpoint of operation. Particularly under radiation condition in the treatment of radioactive wastes, it is not possible to have accessibility at all times in order to serve and repair the device.

It is accordingly an object of the invention to provide a mixing device of this general type which is of relatively simpler construction than that of the heretofore known device and therefore less trouble-prone, and with which it is possible to embed biologically harmful wastes in a binder in an economical and operationally reliable manner.

With the foregoing and other objects in view, there is provided, in accordance with the invention, a mixing device for embedding biologically harmful wastes in a solidifying binder, includes a tubular housing, an assembly of a pre-mixer, a pass-through mixer and a discharge pump having rotatingly movable parts disposed along a common rotational axis and in substantially vertical direction within the tubular housing, and a drive motor mounted at the upper end of the assembly for rotating the movable parts in common, the movable part of the pre-mixer being centrically disposed in the housing, and the movable part of the discharge pump being eccentrically disposed with play in the housing.

The invention provides a considerable simplification because only a single motor operates all of the assembled movable parts or members. The problems in the diversion or redirection from one spindle to the other and in the coordination of the conveyance or transport, which are necessary for a defined end product, are eliminated. Due to the substantially vertical orientation of the housing, the force of gravity is utilized for assisting in the mixing including the pre-mixing and the discharging pumping action.

In addition, the invention avoids any necessity that the mixing tool (as is conventional in descending flow mixers) be continuously withdrawn from or immersed into the product and grows from the inside to the outside due to depositions of the product. On the contrary, a cleaning effect is achieved by the movable member of the pre-mixer guided in the housing, the housing wall being continuously scraped clean.

The movable member of the discharge pump which is eccentrically arranged independently of the mixing effect, and accordingly constructed, can be optimized contrary to the heretofore known device. Therefore, smaller forces are sufficient. This facilitates the mechanical construction and also reduces the likelihood of any disruptions. In addition, the new mixing device can also be cleaned readily, a rinse downwardly discharging adhering dirt or impurities.

In accordance with another feature of the invention, the movable part of the pre-mixer has a flexible structure and is supported so as to be movable with respect to the movable part of the discharge pump. This reduces the settling of encrustations thereon as well as wear.

In accordance with a further feature of the invention, the movable part of the discharge pump is coupled with the drive motor via a part which is rigid in direction of the rotational axis, the rigid part being constructed so as to be divisible between the movable part of the pass-through mixer and the discharge pump.

In accordance with an added feature of the invention, there is provided a feed pipe with which the housing is connected at an acute angle, the feed pipe having an end facing away from the housing and disposed adjacent the drive motor. The feedpipe can extend, for example, directly vertically, while the tubular housing has a given inclination relative to the vertical determined by the acute angle. In addition, the overall height can be reduced as will be shown hereinafter in greater detail. The mixing tool is formed of a middle shaft with a mixing fork as well as an outer centered conveyor screw or worm.

In accordance with an additional feature of the invention, the pre-mixer includes a rod extending parallel to the inner side of the tubular housing and projecting into the vicinity of the pass-through mixer. With such a rod, care can be taken that the mixing zone cannot be jammed. In this connection, the rod acts as a scraper which, with little wear, frees the inside wall of the housing from encrustations and equalizes imbalances due to the design or construction, and produced when the mixing tool rotates.

In accordance with another feature of the invention, the pre-mixer includes a conveyor worm, and the rod projects through recesses formed in the conveyor worm.

Further, in accordance with the invention, the rod is welded to an end of the conveyor worm facing towards the pass-though mixer.

In accordance with yet another feature of the invention, the conveyor worm is an helically wound sheetmetal strip forming a screw-shaped member having a width substantially as great as the inner diameter of the housing. In this connection it should be noted that the width of the sheetmetal strip corresponds to the upper limit of the difference between the inner diameter of the mixer housing and the clearance required by the oscillating motion of the drive shaft.

In accordance with yet a further feature of the invention, the conveyor worm is wound around a shaft having a rectangular cross section and is fastened only at individual points thereto.

More particularly in accordance with yet an additional feature of the invention, the conveyor worm is rigidly fastened only by an uppermost turn thereof to an expanded head part of the shaft. This is advantageous for the reason that, thereby, a given amount of flexibility of the conveyor screw or worm is achieved, the worm contracting as a function of the load and, therefore, changing the outer diameter thereof. By these movements encrustations are prevented from setting and having an adverse effect upon the rotation of the screw or worm and the movement of the material to be transported. By means of the application of an antiadhesion coating, for example, of polytetrafluorethelene, to the mixing tool, the tendency towards encrustation when processing certain materials can be reduced further.

In accordance with a concomitant feature of the invention, the shaft is rigid in direction of the rotational axis and couples the movable part of the discharge pump with the drive motor, the shaft being divisible between the movable part of the pass-through mixer and the discharge pump and has a part divisible therefrom which faces towards the drive motor, the individual fastening points being located on the part divisible from the shaft.

Other features which are considered as characteristic for the invention are set forth in the appended claims.

Although the invention is illustrated and described herein as embodied in mixing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
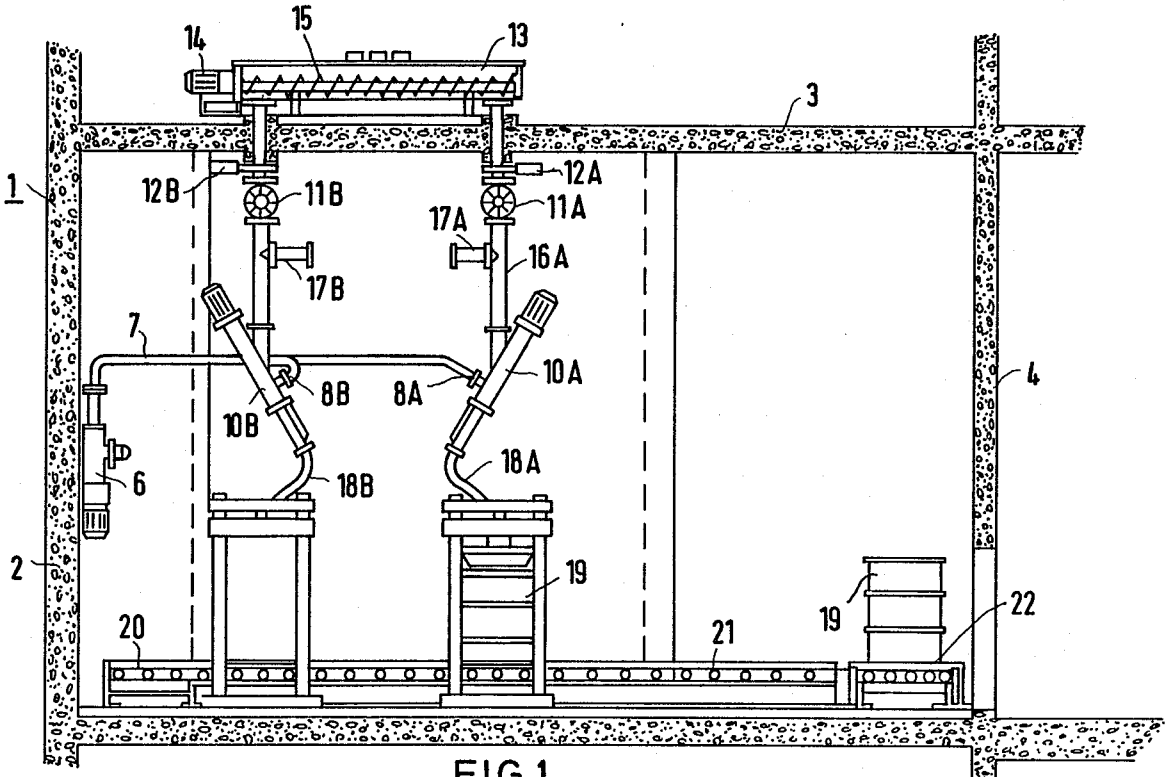
FIG. 1 is a diagrammatic vertical sectional view of an installation for embedding in a binder biologically harmful i.e. radioactive wastes, ecompassing two parallel-arranged mixing devices according to the invention.

Referring now to the drawings and first, particularly, to FIG. 1 thereof, a plant according to the invention is mounted in a building 1 of a nuclear power station which ensures that only controlled access is possible. Walls 2, 3, 4 and so forth of the building 1 are formed of concrete and therefore, provide for the required shielding, because the plant serves for embedding in a binder radioactive wastes such as occur in a nuclear power station during coolant purification, decontamination and the like. This involves, for example, dried ion-exchanger resins, borates which are concentrated by evaporation and optionally dried further, yet also contaminated solids, such as filtering aids, which are comminuted, combustion residues or the like.

A pump 6 is mounted on the wall 2. By means of a pressure line 7, the pump 6 feeds liquid wastes, mixing water or other liquid binder components, as shown in FIG. 1, into inlet stubs or unions 8A, 8B or two like mixing devices 10A and 10B which are arranged symmetrically to one another. The devices 10A and 10B are fed with solid wastes and binders from above via cell wheel locks 11A and 11B, which are connected to a conveyor system 13 via sliders 12A, 12B.

The conveyor system 13 encompasses, for example, a screw 15 which is driven by a motor 14, and by which the device 10A or 10B can be charged depending upon the direction of rotation. Underneath the cell wheel locks 11A and 11B, a respective connection 17A, 17B for a venting system is provided at the vertical feed tubes 16A and 16B, by which exhaust gases can be disposed of controllingly.

The product produced by the devices 10A and 10B, in particular a mixture of wastes, cement and water, travels through discharge hoses 18A and 18B, respectively, into barrels 19, which are brought by a conveyor belt 20 to a conveyor belt 21 on which they stand at the devices 10A and 10B. After the barrels 19 have been filled, they can be transported by a conveyor belt 22 to an exit.

Figure 2:
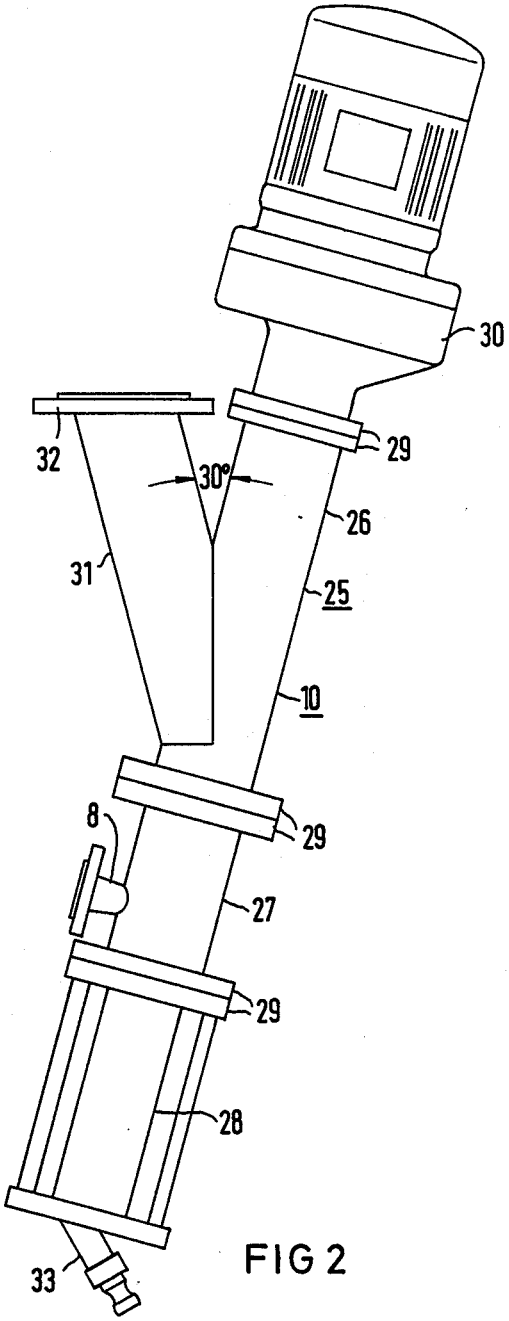
FIG. 2 is an enlarged fragmentary view of FIG. 1 showing one of the mixing devices in a side elevational view.

As shown in FIG. 2, each mixing device 10 includes a tubular housing 25 with a diameter of, for example, 150 mm. It is formed of three cylindrical sections 26, 27 and 28 which are connected via flanges 20 to one another and to a gear reduction motor 30. In this regard, section 26 corresponds to a pre-mixer, section 27 to a continuous-run or pass-through mixer, and section 28 to the discharge pump.

A feed tube 31 is attached to the upper section 26 at an acute angle of 30°, for example, and can, in turn, be connected by a flange 32 thereof to the tube 16A or 16B and to the respective cell wheel lock 11A or 11B. At the lower end of the housing part 28, a nipple 33 is provided to which the discharge hose 18A or 18B can be clamped.

The housing 25 contains the movable members shown in FIGS. 3 to 6 of the mixing device 10, which are connected via a coupler pin 35 to the gear reduction motor 30 as a common drive motor. This involves a conveyor screw or mixing screw 36, a mixing fork 37 and a discharge spindle 38, which are assembled along a common rotational axis 39.

Figure 3:
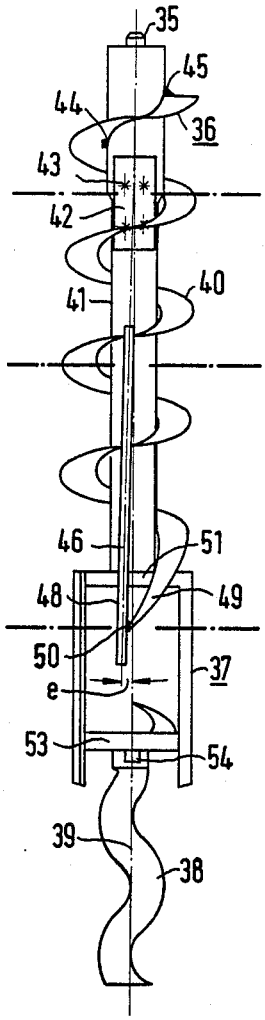
FIG. 3 is an axial view of movable members from within the device.
Figure 4:
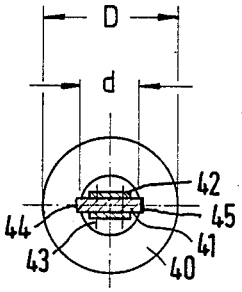
FIGS. 4, 5 and 6 are respective cross-sectional views of FIG. 3 taken along the lines IV—IV, V—V and VI—VI in the directions of the arrows.

The transport screw 36 which serves as a pre-mixer, is formed by a sheetmetal strip 40 which is 6 mm thick, for example, and is wound about a rectangular shaft 41 to form a spindle or screw shaped member having an outer diameter D of 130 mm corresponding to the inner diameter of the housing section 26, 27 (mixing tube) and having an inner diameter d of 45 mm. The rectangular shaft 41 is of divided construction, the divisions thereof being releasably connected by straps 42 and screws 43. The shft 41 is welded together with the sheetmetal strip 40 only at the narrow sides at the motor-side end i.e. in vicinity of the first two thread turns, as is indicated in FIGS. 3 and 4 at 44 and 45.

Figure 5:
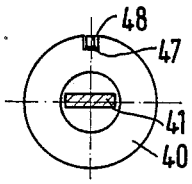
Figure 6:
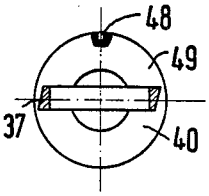

Into recesses 47 of the turns which are disposed rearwardly, when considered in the direction of conveyance or advancement of the sheet metal strip 40, there projects a rod 48 of square cross section which extends at the outer side thereof to the periphery of the sheet metal strip 40, as shown in FIG. 5, so that it extends parallel to the inner side of the housing 25 when in the assembled condition. The rod 48 thus acts as a scraper because the conveyor screw or worm 36 is centered in the housing 25. The lower end 49 of the sheetmetal strip is welded at 50 to the end of the rod 48 facing away from the motor. At that end, the axis 46 of the rod 48 has an eccentricity e of 8 mm with respect to the shaft 41. There, the sheetmetal strip 40 overlaps the mixing fork 37 i.e. into the vicinity of the continuous-run or pass-through mixer.

The mixing fork 37 is firmly connected to the rectangular shaft 41 at 51. At a transverse or diagonal truss 53 of the mixing fork 37, a coupling pin 54 is seated, via which a corresponding counterpart discharge spindle 38 is attached. The mixing fork 37 and the discharge spindle 38 which are mounted with play in the housing section 27 and 28, execute planetary motions which are due to the eccentricity e.

The foregoing is a description corresponding, in substance, to German application No. P 34 29 412.0, dated Aug. 9, 1984, International priority of which is being claimed for the instant application, and which is hereby made part of this application. Any material discrepancies between the foregoing specification and the specification of the aforementioned corresponding German application are to be resolved in favor of the latter.

There is claimed:

1. Mixing device for embedding biologically harmful wastes in a solidifying binder, comprising a tubular housing, an assembly of a pre-mixer, a pass-through mixer and a discharge pump each having a rotatingly movable part disposed along a common rotational axis and in substantially vertical direction within said tubular housing, and a drive motor mounted at the upper end of said assembly for rotating said movable parts in common, the movable part of said pre-mixer having a rigid shaft, a helical flexible sheetmetal strip having recesses formed therein in a line substantially parallel to the inner surface of the tubular housing and being wound around said shaft and having an end located adjacent the drive motor, said strip being secured to said shaft only at said end of said strip located adjacent the drive motor, a rod extending through said recesses formed in said helical sheetmetal strip and in a direction substantially parallel to the inner surface of the tubular housing, said rod being movably positioned in said recesses to be movable relative to the helical sheet metal strip, said helical sheetmetal strip forming a flexible screw-shaped member having an outer diameter corresponding to the inner diameter of the tubular housing, and said strip being fixedly secured at the other end thereof to said rod.

2. Mixing device according to claim 1 including a feed pipe with which said tubular housing is connected at an acute angle, said feed pipe having an end facing away from said housing and disposed adjacent said drive motor.

3. Mixing device according to claim 1, wherein said helical sheetmetal strip is secured at said one end to said shaft and at said other end to said rod by respective welds.

4. Mixing device according to claim 1, wherein said helical sheetmetal strip forms a conveyor screw, said sheetmetal strip having a width substantially equal to the inner diameter of the conveyor screw.

5. Mixing device according to claim 1, wherein said shaft is formed of a plurality of separable parts.

6. Mixing device according to claim 1, wherein said movable part of said pass-through mixer is formed as a mixing fork and is fixed at a given point to said shaft, said other end of said helical sheetmetal strip extending away from said drive motor beyond said given point at which said mixing fork is fixed to said shaft and into the vicinity of said mixing fork.

* * * * *